US005233132A

United States Patent [19]

Soucille

[11] Patent Number: 5,233,132

[45] Date of Patent: Aug. 3, 1993

[54] COMPOSITE INSULATOR COMPRISING A FIBER-RESIN ROD AND AN INSULATING COATING MOLDED THEREOVER

[75] Inventor: Maurice Soucille, La Monnerie le Montel, France

[73] Assignee: Sediver Societe Europeenne D'Isolateurs En, Verre Et Composite, France

[21] Appl. No.: 908,556

[22] Filed: Jun. 30, 1992

Related U.S. Application Data

[63] Continuation of Ser. No. 522,489, May 14, 1990, abandoned, which is a continuation-in-part of Ser. No. 103,569, Oct. 1, 1987, abandoned.

[30] Foreign Application Priority Data

Oct. 2, 1986 [FR] France ..... 86 13758

[51] Int. Cl.[5] ..... H01B 17/06

[52] U.S. Cl. ..... 174/179; 174/209; 29/862; 156/60; 156/165; 156/285

[58] Field of Search ..... 174/176-179, 174/186, 194, 195, 209; 24/115 A; 29/517, 862, 871; 264/135, 265; 403/274, 278, 281, 284, 285; 156/60, 156, 165, 285

[56] References Cited

U.S. PATENT DOCUMENTS

| | | | |
|---|---|---|---|
| 806,789 | 12/1905 | Fleeger | 24/115 A X |
| 1,863,048 | 6/1932 | Hayford | 29/517 |
| 3,994,607 | 11/1976 | Kikuchi et al. | 403/284 |
| 4,057,956 | 11/1977 | Tolle | 156/51 X |
| 4,440,975 | 4/1984 | Kaczerginski | 174/179 X |
| 4,476,081 | 10/1984 | Kaczerginski et al. | 264/262 |
| 4,656,720 | 4/1987 | Dumora | 29/520 |
| 4,702,873 | 10/1987 | Kaczerginski | 264/135 |

FOREIGN PATENT DOCUMENTS

| | | | |
|---|---|---|---|
| 203425 | 10/1983 | Dominican Republic | 174/176 |
| 0264684 | 4/1988 | European Pat. Off. | 174/179 |
| 1540329 | 12/1969 | Fed. Rep. of Germany | 174/179 |
| 1932949 | 1/1971 | Fed. Rep. of Germany | 174/179 |
| 662157 | 3/1929 | France | 174/176 |
| 211011 | 6/1984 | German Democratic Rep. | 174/176 |
| 49-26479 | 7/1974 | Japan | 174/176 |
| 57-201639 | 12/1982 | Japan | 264/265 |
| 208510 | 5/1940 | Switzerland | 174/177 |
| 491474 | 7/1970 | Switzerland | 174/176 |
| 2104171 | 3/1983 | United Kingdom | 174/176 |

OTHER PUBLICATIONS

*Handbook of Adhesive Bonding*, edited by Charles V. Cagle, pp. 16-13 and 16-14 of Chapter 16 by James E. Gaughan entitled "Bonding Elastomeric Compounds", copyright 1973 by McGraw-Hill, Inc. (TP-968-C3h).

*The Condensed Chemical Dictionary*, Tenth Edition revised by Gessner G. Hawley, Copyright 1981 by Van Nostrand Reinhold Company, Inc., p. 226 (QD-5-C-5-C60).

*Primary Examiner*—Leo P. Picard

*Assistant Examiner*—Bot L. Ledynh

*Attorney, Agent, or Firm*—Sughrue, Mion, Zinn, Macpeak & Seas

[57] ABSTRACT

A composite insulator (30) comprises a central rod (32) of fibers embedded in a synthetic resin with each end of the rod being fixed to a respective metal end-fitting (31) by a metal sleeve coupling (34) and with the side wall of the rod having a coating (36) of elastomer fins molded thereover. The coating covers the side walls (37) of the end-fittings (31) so as to leave uncovered only those portions (35) which are required for attaching the insulator.

3 Claims, 2 Drawing Sheets

COMPOSITE INSULATOR COMPRISING A FIBER-RESIN ROD AND AN INSULATING COATING MOLDED THEREOVER

This is a Continuation of application Ser. No. 07/522,489 filed May 14, 1990, which is a continuation-in-part application of application Ser. No. 07/103,569 filed Oct. 1, 1987, both now abandoned.

FIELD OF THE INVENTION

The present invention relates to a composite insulator comprising a fiber-resin rod and an insulating coating molded thereover. Such an insulator and a method of manufacturing it are described, in particular, in U.S. Pat. No. 4,476,081. It comprises a rod of fibers embedded in a synthetic resin with the ends of the rod being fastened in respective blind cavities provided in two metal anchoring end-fittings, with the side wall thereof receiving a coating of elastomer fins which are molded thereover, for example using EPDM.

BACKGROUND OF THE INVENTION

Each metal end-fitting, described for example in U.S. Pat. No. 4,656,720, thus has an internal cylindrical housing whose inlet is provided with a flange defining the "inlet plane" of the end-fitting. The creepage distance of the insulator is defined between the "inlet planes" of its two end-fittings.

The insulating coating of the rod must adhere perfectly to the inside face of the flange in order to prevent any trace of dampness reaching the rod which would cause the insulator to deteriorate very rapidly. Further, the inlet to the end-fitting remains a critical region since that is where power arcs are likely to occur which will deteriorate rod anchoring and sealing.

SUMMARY OF THE INVENTION

The aim of the invention is to avoid these drawbacks.

The present invention provides a composite insulator comprising: a central core of fibers agglomerated by a synthetic resin and two metal end-fittings, each metal end fitting having an end in the shape of a full cylinder, and being arranged end-to-end with a corresponding end of said core, a metal sleeve receiving and securing a corresponding end of said core and a respective metal end-fitting at opposite ends of said core, the exterior surface of each metal sleeve and at least one part of a lateral surface of each metal end-fitting having an elastomer-metal adhesive agent applied thereto, and a very high pressure injected ribbed elastomer coating on said core and on the elastomer-metal adhesive agent applied to the exterior surface of each metal sleeve and to said at least one part of the lateral surface of each metal end-fitting, said metal end-fittings each having only one portion necessary for attachment devoid of said elastomer coating, the adhesion of the elastomer coating to the remaining surface of each metal end-fitting being such that a force greater than 10 Newtons/cm is required to tear off said elastomer coating from the surface of each metal end-fitting.

The elastomer-metal adhesive agent is preferably a solution of an organic polymer in a chlorinated xylene solvent.

An insulator is thus obtained having "twofold internal anchoring" and which has numerous advantages. For a given length of insulator, the creepage distance is increased. The anchoring per se is much better protected from the point of view of sealing. Further, the zone where a power arc may occur is at a distance from the anchoring and is on a non-critical portion of the end-fitting.

Any shape of end-fitting may be provided. In particular, the attachment portion of the end-fitting may have any of the following shapes: knob; plate fork; peg; ball-receiving socket; eyelet; and Y-shaped fork.

BRIEF DESCRIPTION OF THE DRAWINGS

Other characteristics and advantages of the present invention appear from the following description of various embodiments given by way of non-limiting example. In the accompanying drawings.

DESCRIPTION OF THE PREFERRED EMBODIMENTS

Figure 1:
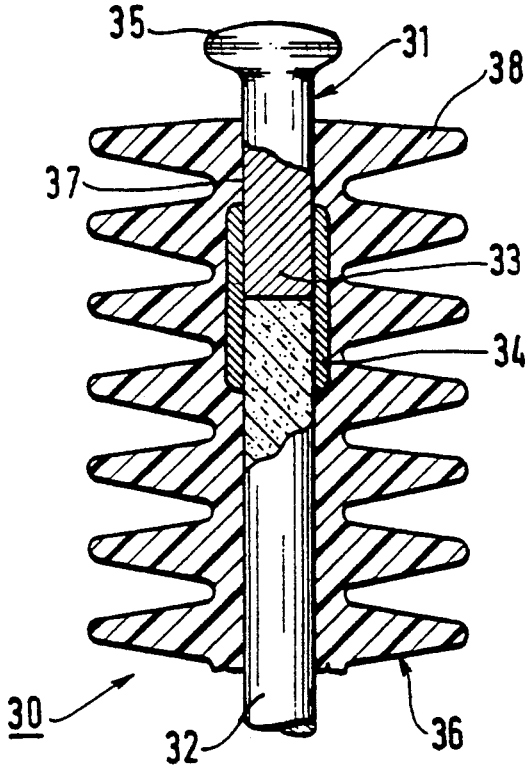
FIGS. 1 and 2 are two fragmentary sections through suspension insulators in accordance with the invention.

The insulator 30 shown in FIG. 1 comprises a central core or rod 32, of fibers agglomerated by a synthetic resin and two metal end-fittings. The end-fitting 31 shown has a cylindrical end 33 of the same diameter as the rod 32 and its other end is in the form of a knob 35. These parts are fixed together by inserting the end of the rod 32 and the end of the end-fitting into a tube 34 of ductile metal, and then by sleeve coupling, for example using the method described in British published patent application No. 2,104,171. The coating of elastomer fins 36 completely covers the tube 34 as well as a large part of the side wall 37 of the end-fitting 31, leaving uncovered only the portion required for attachment to the knob 35. The coating 36 terminates with a fin 38.

This embodiment is particularly advantageous since it is very cheap. The metal part 31 is very simple in shape; the tube 34 may be a steel tube of a kind commonly found in commerce and has no need to be galvanized since it is extremely well protected by the coating 36. In order to obtain perfect adherence between the elastomer coating 36 and the side face 37 of the end-fitting 31 or the side face of the sleeve 34, these side faces should be cleaned in conventional manner and an elastomer-to-metal adherization agent should then be applied. This elastomer-to-metal adherization agent is a solution of organic polymer in a chlorinated xylene solvent. The Handbook of Adhesive Bonding (edited by Charles V. Cagle) gives examples of such agents on page 14 of Chapter 16—"Bonding Elastomeric Compounds"—by James E. Gaughan. The initial surface state of the metal faces is not at all critical, and the quality of the connection between the coating and the end-fitting is quite remarkable: a force of more than 10 N/cm must be applied in order to begin tearing the coating from the surface of the end-fitting. This result is unexpected since in order to mold effectively over the rod and the end-fitting and to eliminate all interstices in order to obtain the desired sealing, it is necessary to inject the elastomer under very high pressure, about 50 bars to 60 bars. It would normally have been expected under the effect of such a pressure that the elastomer-to-metal adherization substance would be at least damaged and that bubbles would appear between the metal faces and the coating thereover. This does not happen.

Figure 2:
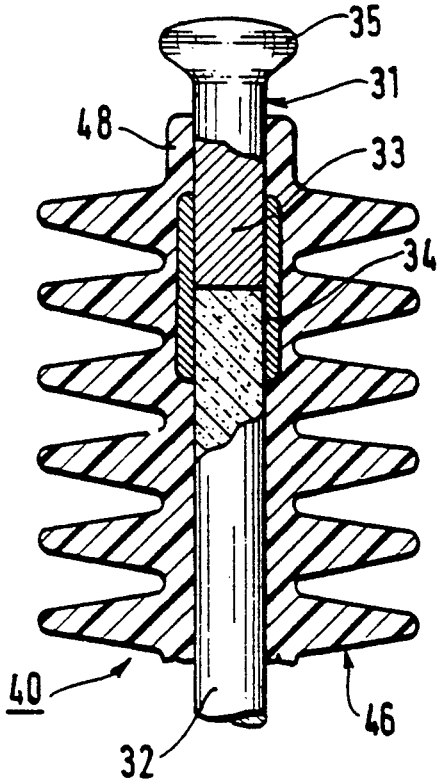

The insulator 40 shown in FIG. 2 is very similar to the insulator 30 in FIG. 1. The same numerals are used to reference items which are identical. The coating 46 differs from the coating 36 in that it terminates with a sleeve 48.

Figure 3:
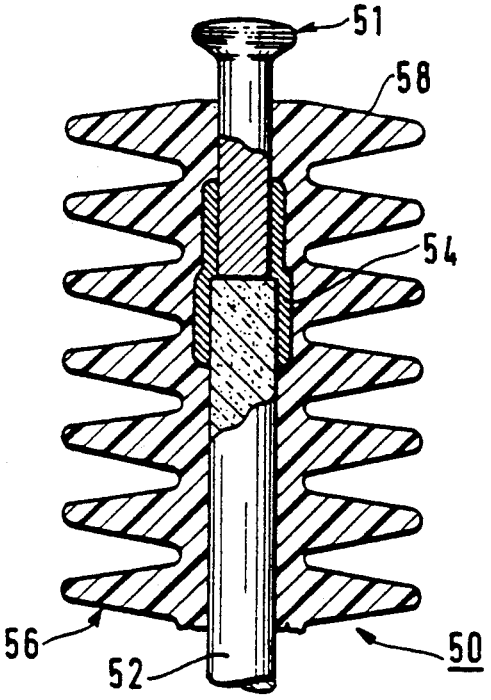
FIGS. 3 and 4 show variants of FIGS. 1 and 2 in which the diameter of the rod is greater than the diameter of the end-fitting.
Figure 4:
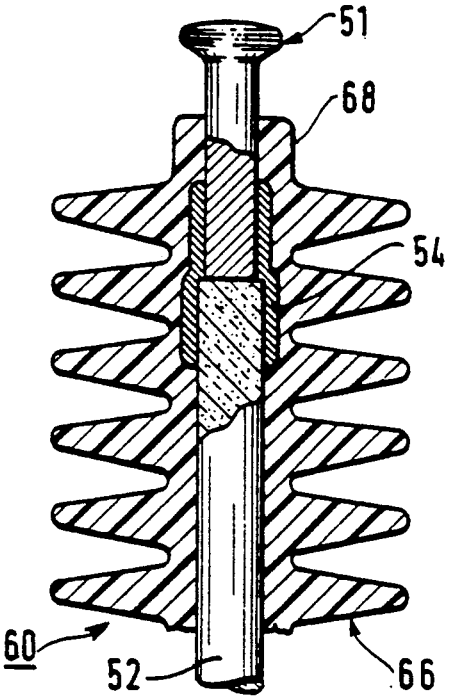

In the insulator 50 shown in FIG. 3, the configuration is similar but the cylindrical end of the end-fitting 51 is of smaller diameter than the rod 52. A metal tube 54 can still be used to provide a sleeve coupling. The coating 56 terminates with a fin 58, whereas FIG. 4 shows the coating 66 of an insulator 60 terminating with a sleeve 68.

Figure 5:
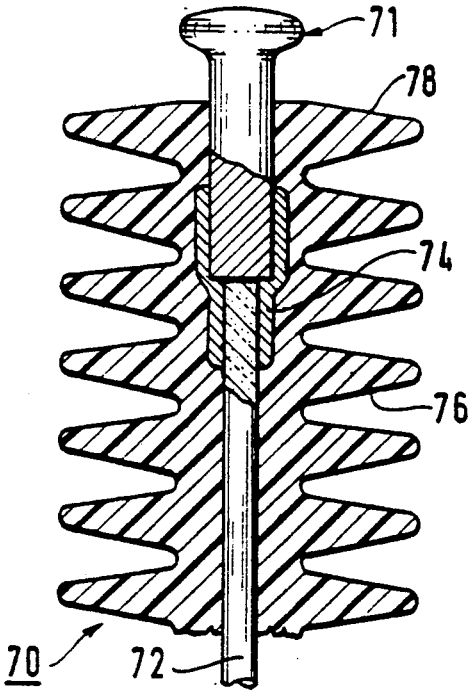
FIGS. 5 and 6 show variants of FIGS. 1 and 2 in which the diameter of the rod is less than the diameter of the end-fitting.
Figure 6:
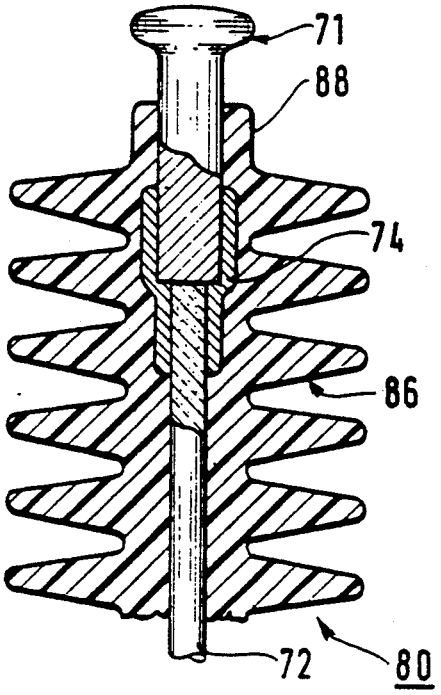

In insulator 70 of FIG. 5, it is the rod 72 which is smaller in diameter than the cylindrical end of the end-fitting 71. A tube 74 is used to provide a sleeve coupling and the elastomer coating 76 terminates with a fin 78, whereas on the insulator 80 shown in FIG. 6, the coating 86 terminates with a sleeve 88.

Naturally, the invention is not limited to the examples described above. The shapes of the end-fittings could be different.

In all variants the creepage distance of the insulator is longer than in prior art arrangements, in particular by virtue of the fact that additional fins can be provided. The electrical performance of such an insulator is therefore improved.

Further, the path along which drops of water must run prior to reaching the anchorage per se has also been considerably lengthened.

Further, power arcs which used to run the risk of damaging the anchorage in prior art arrangements now take place in the outer end zones of the end-fittings, and this does not cause significant damage.

The end-fittings are made in particular of a material selected from: steel; cast iron; bronze; and aluminum.

The invention is applicable, for example, to suspension insulators for voltages up to beyond 735 Kvolts.

I claim:

1. A composite insulator comprising: a central core of fibers agglomerated by a synthetic resin and two metal end-fittings, each metal end-fitting having an end in the shape of a full cylinder and being arranged end-to-end with a corresponding end of said core, a metal sleeve receiving and securing a corresponding end of said core and a respective metal end-fitting at opposite ends of said core, the exterior surface of each metal sleeve and at least one part of a lateral surface of each metal end-fitting having an elastomer-metal adhesive agent applied thereto, and a very high pressure injected ribbed elastomer coating on said core and on the elastomer-metal adhesive agent applied to the exterior surface of each metal sleeve and to said at least one part of the lateral surface of each metal end-fitting, said metal end-fittings each having only one portion necessary for attachment devoid of said elastomer coating, the adhesion of the elastomer coating to the remaining surface of each metal end-fitting being such that a force greater than 10 Newtons/cm is required to tear off said elastomer coating from the surface of each metal end-fitting.

2. A composite insulator according to claim 1, wherein the attachment portions of said metal end-fittings are of one of the following shapes: plate, peg, knob, fork, ball-receiving socket, and eyelet.

3. A composite insulator according to claim 1, wherein said metal end-fittings are made of a material chosen from the group consisting of: steel, cast iron, bronze, and aluminum.

* * * * *